US008635740B2

(12) United States Patent
Gordon et al.

(10) Patent No.: US 8,635,740 B2
(45) Date of Patent: Jan. 28, 2014

(54) FLOW CONTROL OF AN EXTRACTOR CLEANING MACHINE

(75) Inventors: Evan A. Gordon, Canton, OH (US); John R. Bantum, Munroe Falls, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 31 days.

(21) Appl. No.: 13/224,199

(22) Filed: Sep. 1, 2011

(65) Prior Publication Data

US 2012/0047678 A1 Mar. 1, 2012

Related U.S. Application Data

(60) Provisional application No. 61/379,244, filed on Sep. 1, 2010.

(51) Int. Cl.
*A47L 7/00* (2006.01)

(52) U.S. Cl.
USPC ..... 15/320

(58) Field of Classification Search
USPC ..... 15/319, 320, 321, 340.1, 340.2, 340.3, 15/340.4, 353
See application file for complete search history.

(56) References Cited

U.S. PATENT DOCUMENTS

| | | | | |
|---|---|---|---|---|
| 3,766,595 | A * | 10/1973 | Valbona et al. | 15/339 |
| 3,848,291 | A | 11/1974 | Morse | |
| 4,218,900 | A | 8/1980 | Caplan et al. | |
| 4,485,518 | A | 12/1984 | Kasper | |
| 4,542,556 | A | 9/1985 | Hepple | |
| 5,493,752 | A | 2/1996 | Crouser et al. | |
| 5,761,763 | A | 6/1998 | McAllise et al. | |
| 5,799,361 | A | 9/1998 | Reed et al. | |
| 5,887,313 | A | 3/1999 | Hanold et al. | |
| 6,421,862 | B2 | 7/2002 | Lesco et al. | |
| 6,533,871 | B2 | 3/2003 | Zahuranec et al. | |
| 6,536,071 | B2 | 3/2003 | Zahuranec et al. | |
| 6,571,421 | B1 * | 6/2003 | Sham et al. | 15/320 |
| 6,681,442 | B2 | 1/2004 | Coates et al. | |
| 6,836,928 | B2 * | 1/2005 | Zahuranec et al. | 15/320 |
| 7,048,804 | B2 | 5/2006 | Kisela et al. | |
| 7,237,299 | B2 | 7/2007 | Tondra et al. | |
| 7,240,394 | B2 | 7/2007 | Kegg et al. | |

(Continued)

FOREIGN PATENT DOCUMENTS

WO 0106904 2/2001

OTHER PUBLICATIONS

PCT/US2011/050254 International Search Report and Written Opinion dated Feb. 6, 2012 (10 pages).

*Primary Examiner* — Robert Scruggs
(74) *Attorney, Agent, or Firm* — Michael Best & Friedrich LLP

(57) ABSTRACT

An extractor cleaning machine includes a base or foot having a distribution nozzle and a suction nozzle. A suction source fluidly communicates with the suction nozzle, and a distributor fluidly communicates with the distribution nozzle. The distributor delivers cleaning fluid to the distribution nozzle and has first and second non-zero operating speeds. A first manually operable actuator associated with the distributor changes the distributor from the first operating speed to the second operating speed. The distributor also includes a third non-zero operating speed, and a second manually operable actuator associated with the distributor changes the distributor from the second operating speed to the third operating speed.

24 Claims, 5 Drawing Sheets

(56) References Cited

U.S. PATENT DOCUMENTS

| | | | | |
|---|---|---|---|---|
| 7,269,879 | B2 | 9/2007 | Kegg et al. | |
| 7,362,064 | B2 | 4/2008 | Coates et al. | |
| 7,392,566 | B2 | 7/2008 | Gordon et al. | |
| 7,624,473 | B2 | 12/2009 | Kegg et al. | |
| 7,657,965 | B2 | 2/2010 | Scott et al. | |
| 7,774,894 | B2 | 8/2010 | Rippl et al. | |
| 7,954,200 | B2 | 6/2011 | Leonatti et al. | |
| 2001/0014987 | A1* | 8/2001 | Lesco et al. | 8/158 |
| 2002/0083548 | A1 | 7/2002 | Hansen | |
| 2003/0159231 | A1 | 8/2003 | Oh | |
| 2004/0221415 | A1 | 11/2004 | Tondra et al. | |
| 2006/0288517 | A1 | 12/2006 | Oh et al. | |
| 2007/0234503 | A1 | 10/2007 | Krebs et al. | |
| 2008/0196193 | A1 | 8/2008 | Huffman et al. | |
| 2009/0094782 | A1 | 4/2009 | Lenkiewicz | |
| 2009/0165822 | A1 | 7/2009 | Kintz et al. | |
| 2011/0079248 | A1* | 4/2011 | Huffman et al. | 134/21 |

* cited by examiner

FLOW CONTROL OF AN EXTRACTOR CLEANING MACHINE

CROSS-REFERENCE TO RELATED APPLICATION

This application claims the benefit of and priority to U.S. Provisional Patent Application No. 61/379,244, filed Sep. 1, 2010, the entire contents of which are hereby incorporated by reference.

BACKGROUND

The present invention relates to extractor-type surface cleaning machines and, more particularly, to flow control of cleaning solution for extractor cleaning machines.

SUMMARY

In some embodiments, the invention provides an extractor cleaning machine including a base movable along a surface to be cleaned. The base includes a distribution nozzle and a suction nozzle. A suction source is supported by the base and is in fluid communication with the suction nozzle. A pump is in fluid communication with the distribution nozzle and is operable to deliver cleaning fluid to the distribution nozzle. The pump has a first operating speed and a second operating speed that are both non-zero operating speeds. The second operating speed is higher than the first operating speed. A manually operable actuator is operable to change the pump from the first operating speed to the second operating speed.

The actuator can be a first actuator and the extractor cleaning machine can also include a second manually operable actuator. The pump can have a third operating speed that can be higher than the second operating speed, and the machine can be configured such that manually operating the second actuator increases the pump speed to the third operating speed. The extractor cleaning machine can also include a handle pivotally coupled to the base, where the first actuator and the second actuator are positioned on and pivotable with the handle. The extractor cleaning machine can also include a normally-closed valve between the pump and the distribution nozzle such that manually operating the actuator opens the valve and allows cleaning fluid to flow from the pump to the distribution nozzle. The extractor cleaning machine can be configured such that manually operating the actuator substantially simultaneously opens the valve and changes the pump from the first operating speed to the second operating speed. The extractor cleaning machine can be configured such that flow of cleaning fluid to the distribution nozzle is precluded when the pump operates at the first operating speed. The extractor cleaning machine can also include an accessory hose in communication with the suction source and the pump. The accessory hose can include a manually-operable hand tool such that operation of the hand tool delivers cleaning fluid to the surface while the pump operates at the first operating speed. The extractor cleaning machine can also include a switch associated with the actuator and in electrical communication with the pump, such that the switch changes state in response to manual operation of the actuator to increase a voltage supplied to the pump. The pump can be configured to increase in operating speed from the first operating speed to the second operating speed in response to the increase in voltage.

In other embodiments, the invention provides an extractor cleaning machine including a base movable along a surface to be cleaned and including a distribution nozzle and a suction nozzle. A handle is pivotally coupled to the base for moving the base along the surface to be cleaned. A suction source is supported by the base and is in fluid communication with the suction nozzle. An accessory hose is in fluid communication with the suction source. A distributor is supported by the base and is in fluid communication with the distribution nozzle and the accessory hose. The distributor is operable to deliver cleaning fluid to the distribution nozzle and to the accessory hose and has a first operating speed associated with delivery of cleaning fluid to the accessory hose at a first flow rate, a second operating speed associated with delivery of cleaning fluid to the distribution nozzle at a second flow rate. The distributor also has a third operating speed associated with delivery of cleaning fluid to the distribution nozzle at a third flow rate that is greater than the second flow rate. The first, second, and third operating speeds are non-zero operating speeds. The second operating speed is higher than the first operating speed, and the third operating speed is higher than the second operating speed.

The extractor cleaning machine can also include a manually operable actuator, such that actuation of the manually operable actuator causes the distributor to change from operation at the first operating speed to operation at the second operating speed. The extractor cleaning machine can be configured such that the manually operable actuator is a first manually operable actuator and the extractor cleaning machine also includes a second manually operable actuator, such that actuation of the second manually operable actuator causes the distributor to change from operation at the second operating speed to operation at the third operating speed. The extractor cleaning machine can be configured such that the first manually operable actuator and the second manually operable actuator are both located on the handle. The extractor cleaning machine can also include a first microswitch and a second microswitch, such that actuation of the first manually operable actuator closes the first microswitch to increase a voltage supplied to the distributor, and such that actuation of the second manually operable actuator closes the second microswitch to further increase the voltage supplied to the distributor. The extractor cleaning machine can also include a valve between the distributor and the distribution nozzle. The valve can be configured to be closed during operation of the distributor at the first operating speed, and the extractor cleaning machine can be configures such that actuation of the first manually operable actuator opens the valve to permit flow of cleaning fluid from the distributor to the distribution nozzle.

In still other embodiments, the invention provides an extractor cleaning machine includes a base movable along a surface to be cleaned and including a distribution nozzle and a suction nozzle. A handle is coupled to the base to facilitate movement of the base along the surface. A suction source is in fluid communication with the suction nozzle and is operable to draw fluid and dirt from the surface through the suction nozzle. A recovery tank is in fluid communication with the suction source to receive and store fluid and dirt drawn through the suction nozzle. A distributor is in fluid communication with the distribution nozzle and is operable to distribute a cleaning fluid to the surface. A supply tank is configured to receive and store the cleaning fluid and is in fluid communication with the distributor for supplying the cleaning fluid to the distributor. A manually operable actuator is electrically coupled to the distributor. A first voltage is supplied to the distributor such that the distributor outputs the cleaning fluid at a first flow rate. The first voltage and the first flow rate are greater than zero. When the actuator is actuated, a second voltage is supplied to the distributor such that the distributor outputs the cleaning fluid at a second flow rate.

The second voltage is greater than the first voltage and the second flow rate is greater than the first flow rate.

The extractor cleaning machine can be configures such that the actuator is a first actuator and can also include a second actuator that is also manually operable and electrically coupled to the distributor. The second actuator can be configures such that, when actuated, a third voltage is supplied to the distributor such that the distributor outputs the cleaning fluid at a third flow rate. The third voltage can be greater than the second voltage and the third flow rate can be greater than the second flow rate. The extractor cleaning machine can also include an accessory conduit in fluid communication with the distributor, such that the distributor distributes the cleaning fluid at the first flow rate through the accessory conduit and distributes the cleaning fluid at the second flow rate through the distribution nozzle. The extractor cleaning machine can also include a valve between the distributor and the distribution nozzle. The valve can be configured to be closed when the first voltage is supplied to the distributor and opened when the second voltage is supplied to the distributor. The valve can be configured to open in response to operation of the actuator.

In still other embodiments, the invention provides an extractor cleaning machine including a base including a floor-cleaning distribution nozzle and a hose coupled to the base. The hose includes a surface-cleaning nozzle. A distributor has an off configuration, a first operating speed, a second operating speed greater than the first operating speed, and a third operating speed greater than the second operating speed. The distributor is in selective fluid communication with the floor-cleaning distribution nozzle and the surface-cleaning nozzle. The distributor operates at the first operating speed for supplying cleaning fluid to the surface-cleaning nozzle, and operates at one of the second operating speed and the third operating speed for supplying cleaning fluid to the floor-cleaning distribution nozzle.

The extractor cleaning machine can be configured such that when the extractor cleaning machine is turned on, the distributor changes from the off configuration to the first operating speed. The extractor cleaning machine can also be configured such that the hose includes a normally-closed stop-valve and when the extractor cleaning machine is turned on and the stop-valve is opened, the surface-cleaning nozzle discharges cleaning fluid at an accessory-cleaning flow rate associated with the first operating speed. The extractor cleaning machine can also include a first actuator and a valve positioned to interrupt fluid communication between the distributor and the floor-cleaning distribution nozzle. The valve can be such that it is closed when the distributor operates at the first operating speed and such that actuating the first actuator can open the valve and increase the distributor speed from the first operating speed to the second operating speed. The extractor cleaning machine can also include a second actuator such that actuating the second actuator increases the distributor speed from the second operating speed to the third operating speed.

Before any embodiments of the invention are explained in detail, it is to be understood that the invention is not limited in its application to the details of construction and the arrangement of components set forth in the following description or illustrated in the above-described drawings. The invention is capable of other embodiments and of being practiced or of being carried out in various ways.

DETAILED DESCRIPTION

Figure 1:
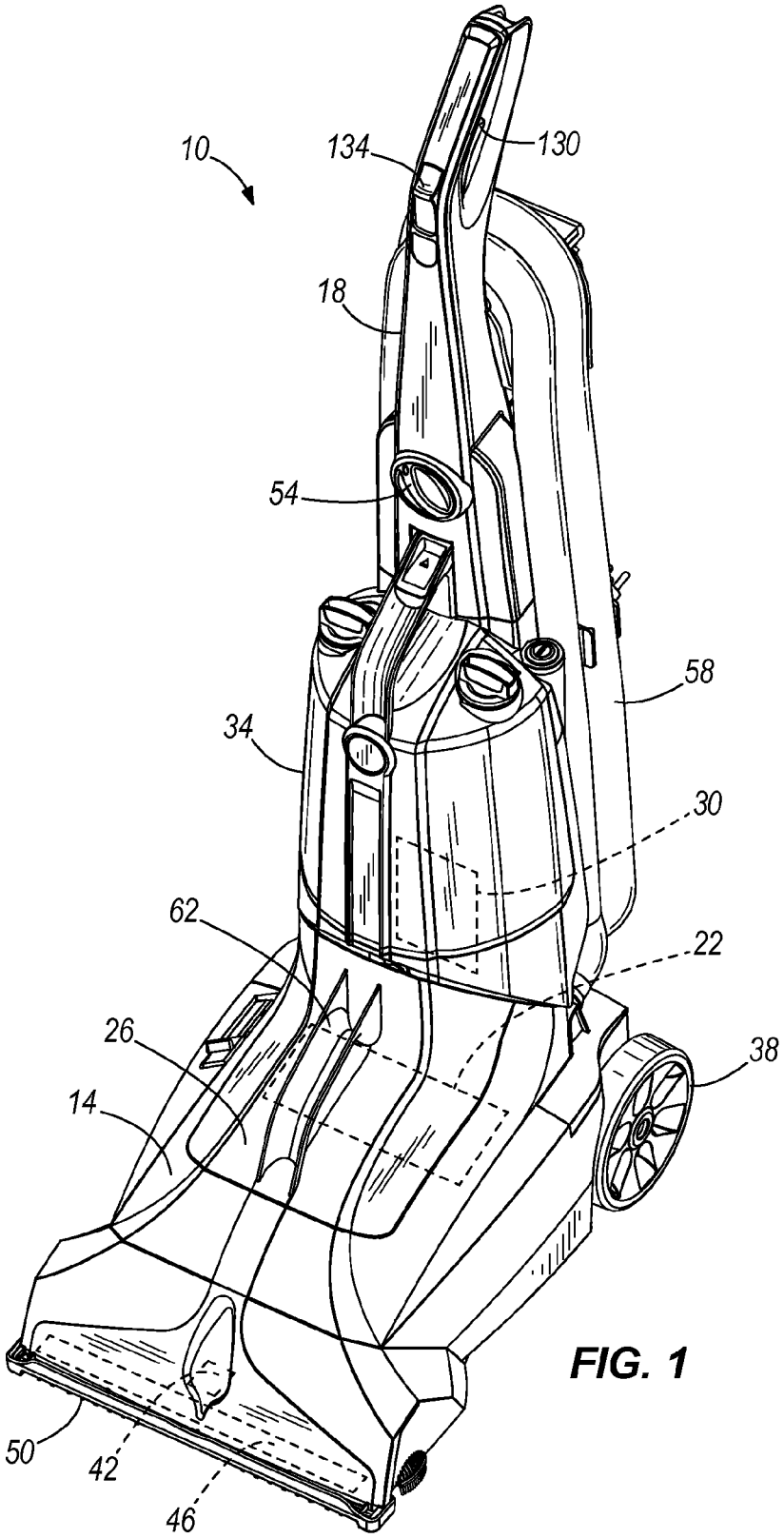
FIG. 1 is a perspective view of an extractor cleaning machine embodying the invention.

FIG. 1 illustrates an extractor-type surface cleaning machine 10 (herein referred to simply as an "extractor"). In the illustrated embodiment, the extractor 10 is an upright extractor operable to clean a surface, such as, for example, a floor. In some embodiments, the extractor 10 may be adapted to clean a variety of surfaces, such as carpets, hardwood floors, tiles, or the like. The extractor 10 distributes or sprays a cleaning fluid (e.g., water, detergent, or a mixture of water and detergent) onto the surface to clean the surface. The extractor 10 then draws the cleaning fluid and any dirt off the surface, leaving the surface relatively clean and dry.

The illustrated extractor 10 includes a base in the form of a foot 14 (other non-upright type extractors might include a different type of base), a handle 18 coupled to the foot 14, a suction source 22 supported by the foot 14, a recovery tank 26 coupled to the foot 14, a distributor 30 supported by the handle 18, and a supply tank 34 coupled to the handle 18. The foot 14 is movable along the surface to be cleaned and supports the other components of the extractor 10. Two wheels 38 (only one of which is shown in FIG. 1) are coupled to the foot 14 to facilitate movement of the foot 14 along the surface. In the illustrated embodiment, the wheels 38 are idle wheels. In other embodiments, the wheels 38 may be driven wheels.

As shown in FIG. 1, the foot 14 includes a distribution nozzle 42, a suction nozzle 46, and a brush assembly 50. The distribution nozzle 42 is coupled to a lower surface of the foot 14 to direct cleaning fluid toward the surface to be cleaned. The suction nozzle 46 is also coupled to the lower surface of the foot 14 to draw fluid and dirt from the surface to be cleaned back into the recovery tank 26 of the extractor 10. The brush assembly 50 is coupled to the lower surface of the foot 14 adjacent the nozzles 42, 46 to scrub the surface to be cleaned. The brush assembly 50 also helps inhibit fluid from flowing beyond a periphery of the foot 14. In some embodiments, individual brushes of the brush assembly 50 may be electrically or pneumatically rotated to agitate and scrub the surface.

The illustrated handle 18 is pivotally coupled to and extends from the foot 14. The handle 18 is pivotable or tiltable relative to the foot 14 from a generally vertical or upright storage position (as shown in FIG. 1) to an infinite number of non-vertical or reclined operating positions. Pivoting the handle 18 to one of the operating positions facilitates moving the foot 14 along the surface. The handle 18 supports a mode knob 54 to adjust the operating mode of the extractor 10. For example, the mode knob 54 may be rotated to control whether only water or a mixture of water and detergent is distributed by the extractor 10 onto the surface. The handle 18 also supports an accessory hose 58. The accessory hose 58 is connectable to a variety of hand-held tools to help clean smaller surfaces, such as, for example, steps.

The suction source 22 is in fluid communication with the suction nozzle 46 and the accessory hose 58 to draw fluid and dirt from the surface through the nozzle 46 or the accessory hose 58. In one embodiment, the suction source 22 includes a fan that generates a vacuum to draw the fluid and dirt through the nozzle 46 and the accessory hose 58. In the illustrated embodiment, the suction source 22 is supported by the foot 14 generally underneath the recovery tank 26. In other embodiments, the suction source 22 may be supported by the handle 18 or may be positioned elsewhere on the extractor 10.

The recovery tank 26 is in fluid communication with the suction source 22, the suction nozzle 46, and the accessory hose 58 to receive and store the fluid and dirt drawn through the nozzle 46 or through the accessory hose 58. The illustrated recovery tank 26 is removably coupled to an upper surface of the foot 14. The recovery tank 26 includes a lift handle 62 to facilitate removing and handling the tank 26 apart from the extractor 10. In other embodiments, the recovery tank 26 may be supported by the handle 18 of the extractor 10.

Figure 3:
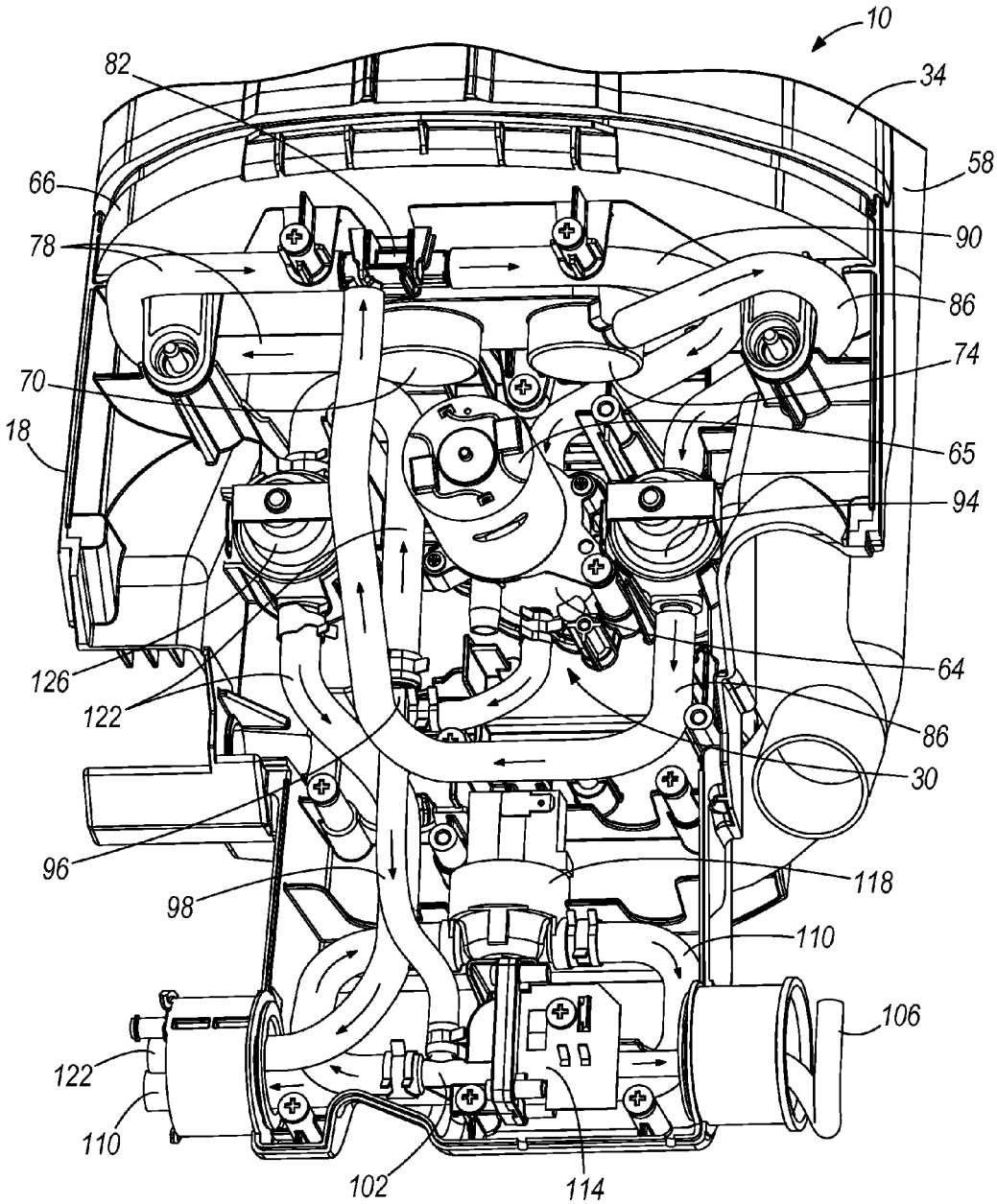
FIG. 3 is a perspective view of a portion of the extractor cleaning machine showing internal components of the machine and arrows indicating directions of flow through the internal components.

The distributor 30 is in fluid communication with the distribution nozzle 42 and an accessory conduit 106 (FIG. 3) coupled to the accessory hose 58. The distributor 30 draws cleaning fluid from the supply tank 34 and distributes the fluid to the surface to be cleaned through either the distribution nozzle 42 or the accessory conduit 106. As shown in FIG. 3, in the illustrated embodiment, the distributor 30 includes a pump 64 and a motor 65 that drives the pump 64. In one embodiment, the pump 64 is a gear pump having an internal bypass for circumstances where the pump is running but no cleaning fluid is being distributed by the extractor 10. When the distributor 30 is switched from an off configuration to an on configuration, the pump 64 pressurizes cleaning fluid and urges it toward the distribution nozzle 42 and/or to the accessory conduit 106. The pump 64 draws cleaning fluid (e.g., water, detergent, or both) from the supply tank 34, mixes the cleaning fluid (if necessary), and distributes the cleaning fluid onto the surface. In the illustrated embodiment, the distributor 30 is supported by the handle 18 generally behind the supply tank 34. In other embodiments, the distributor 30 may be supported by the foot 14 or may be positioned elsewhere on the extractor 10.

Referring back to FIG. 1, the supply tank 34 is coupled to and supported by the handle 18. As such, the supply tank 34 is pivotable with the handle 18 relative to the foot 14. The supply tank 34 receives and stores cleaning fluid and supplies the cleaning fluid to the distributor 30. In the illustrated embodiment, the supply tank 34 is removably coupled to the handle 18 such that the supply tank 34 is only in fluid communication with the distributor 30 when the tank 34 is supported on the handle 18. In other embodiments, the supply tank 34 may be supported by the foot 14 of the extractor 10.

Figure 2:
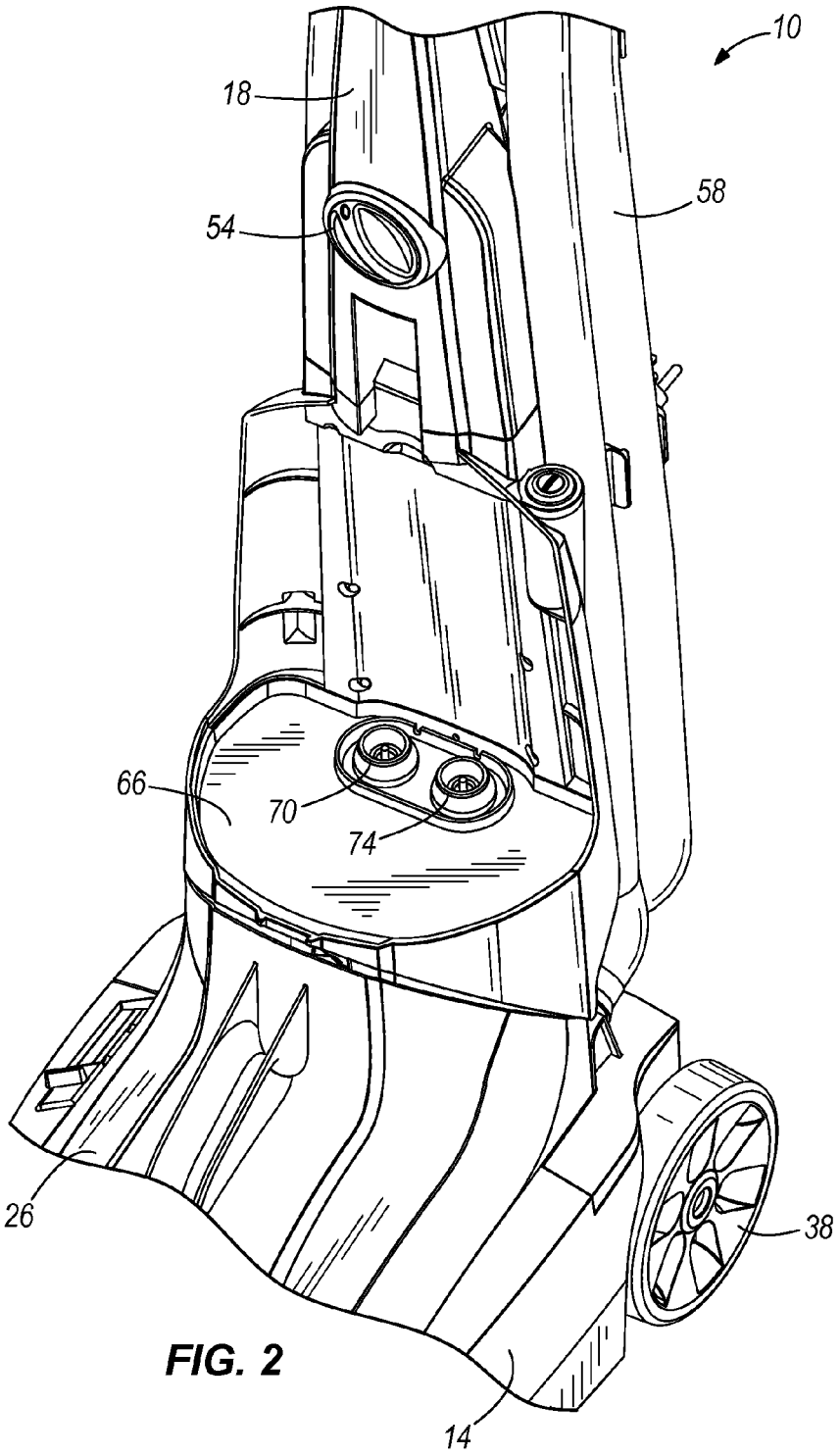
FIG. 2 is a perspective view of a portion of the extractor cleaning machine shown in FIG. 1 without a supply tank attached.

As shown in FIG. 2, the handle 18 includes a tank tray 66 for supporting the supply tank 34. The tank tray 66 includes a water port 70 and a detergent port 74 that connect to the supply tank 34 when the supply tank 34 is supported on the tray 66. As shown in FIG. 3, a water conduit 78 extends from the water port 70, makes two approximately 90-degree bends and couples to a connector 82. A detergent conduit 86 extends from the detergent port 74 downwardly and through a detergent solenoid 94, laterally and below the pump 64 and motor 65, and finally upwardly to the connector 82. The detergent conduit 86 conducts detergent from the supply tank 34 to the connector 82, but can be selectively interrupted by the detergent solenoid 94 to prevent the flow of detergent to the connector 82. In the illustrated embodiment, the solenoid 94 is disposed within the detergent conduit 86 to selectively restrict flow through the detergent conduit 86. When closed, the solenoid 94 prevents detergent from flowing to the connector 82. The connector 82 includes internal orifices that are sized to mix at a predetermined ratio the water received from the water conduit 78 and the detergent received from the detergent conduit 86. A fluid conduit 90 extends from the connector 82 and carries water (if the detergent conduit 86 is blocked by the detergent solenoid 94) or a mix of water and detergent (if the detergent conduit 86 is opened) to an inlet of the pump 64.

The pump 64 pumps the fluid through a short conduit to a T-connector 96. A cleaning conduit 98 extends downwardly from the T-connector 96 and directs cleaning fluid (e.g., water or a mixture of water and detergent) from the pump 64 to a connector 102. The connector 102 directs the cleaning fluid either to the accessory hose 58 through an accessory conduit 106 (to the right of the connector 102 in FIG. 3) or to the distribution nozzle 42 through a floor conduit 110 (to the left of the connector 102 in FIG. 3).

In the illustrated embodiment a conduit extends away from connector 102, makes an approximately 180 degree bend, and carries fluid to a valve 118. The floor conduit 110 extends from the valve 118, makes another approximately 180 degree bend, extends underneath various other components (as viewed in FIG. 3), and exits to the left. The valve 118 selectively restricts flow through the floor conduit 110 and is normally closed to prevent cleaning fluid from flowing to the distribution nozzle 42 unless actuated (e.g., opened) by a user, as further discussed below.

In the illustrated embodiment, a flow sensor 114 is positioned to the right of the connector 102 and is in communication with the accessory conduit 106. The flow sensor 114 detects flow in the accessory conduit 106 and opens or closes the detergent solenoid 94 depending on the position of the mode knob 54 (FIG. 1). If the knob is in a wash mode the solenoid 94 will be opened to distribute a mixture of water and detergent from the supply tank 34, whereas if the mode knob 54 is in a rinse mode the solenoid 94 will be closed to distribute water from the supply tank 34. It should be appreciated that some cross-contamination will occur when changing between the rinse and wash modes due to the water and/or water and detergent solution contained in the various conduits.

The accessory hose 58 includes at its end a hand-tool (not shown) having a surface-cleaning nozzle that fluidly communicates with the accessory conduit 106. The surface-cleaning nozzle can be used to apply cleaning fluid to a surface to be cleaned that is generally not easily cleanable using the foot 14, such as stairs or a vertical surface. The surface-cleaning nozzle includes a manually operated stop-valve that selectively affords and prevents fluid communication between the accessory conduit 106 and the surface-cleaning nozzle. The stop-valve can be actuated by a user to spray cleaning fluid onto the surface to be cleaned. The flow sensor 114 is provided on the accessory conduit 106 in the illustrated embodiment primarily because the stop-valve of the illustrated accessory hose 58 is a simple mechanical valve. The flow sensor 114 therefore indicates when the mechanical valve has been opened to delivery fluid. Alternative embodiments can include an accessory hose 58 provided with an electrical switch or similar device that produces an electrical signal upon operation of the hand-held tool, the flow sensor 114 could be eliminated.

In the illustrated embodiment, a rinse conduit 122 directs water from the pump 64 to the distribution nozzle 42 for rinsing the floor without detergent. The rinse conduit 122 extends upwardly from the T-connector 96, makes an approximately 180 degree bend and passes through a rinse solenoid 126 that is operable to selectively restrict flow through the conduit 122. For example, the rinse solenoid 126 may be opened when the mode knob 54 (FIG. 1) is rotated to a rinse mode to distribute only water (i.e., without detergent) from the supply tank 34. When the rinse solenoid 126 is opened, the valve 118 and detergent solenoid 94 are both closed. In other embodiments, the rinse conduit 122 may be a gravity fed line extending directly from the water port 70 or the connector 82 to the distribution nozzle 42, rather than a pressurized line extending from the pump 64. The rinse conduit 122 extends downwardly from the rinse solenoid 126 and exits to the left. At a downstream location close to the distribution nozzle 42 the rinse conduit 122 and the floor conduit 110 are joined together by a Y-connector (not shown) that is in turn connected to the distribution nozzle 42. Having a rinse conduit 122 distinct from the floor conduit 110 reduces the cross-contamination of water and the water/detergent mix when switching between the rinse mode and the wash mode.

When the extractor 10 is turned on a first voltage is applied to the motor 65 and the motor drives the pump 64 at a relatively low pump speed. The normally closed valve 118 prevents cleaning fluid from flowing through the floor conduit 110 to the distribution nozzle 42. Similarly, the normally closed stop-valve on the hand-tool of the accessory hose 58 prevents cleaning fluid from flowing through the nozzle of the accessory hose 58. Thus, even though the pump 64 is operating, there is no distribution of cleaning fluid from the extractor 10. In the illustrated embodiment, the internal bypass of the pump 64 relieves the pressure that would otherwise accumulate due to the lack of fluid flow through the rest of the system. Other embodiments using pumps that may not include an internal bypass can incorporate additional conduits, check valves, and other suitable components to provide a distinct recirculating bypass path for circulating fluid from the pump outlet back to the pump inlet.

Figure 4:
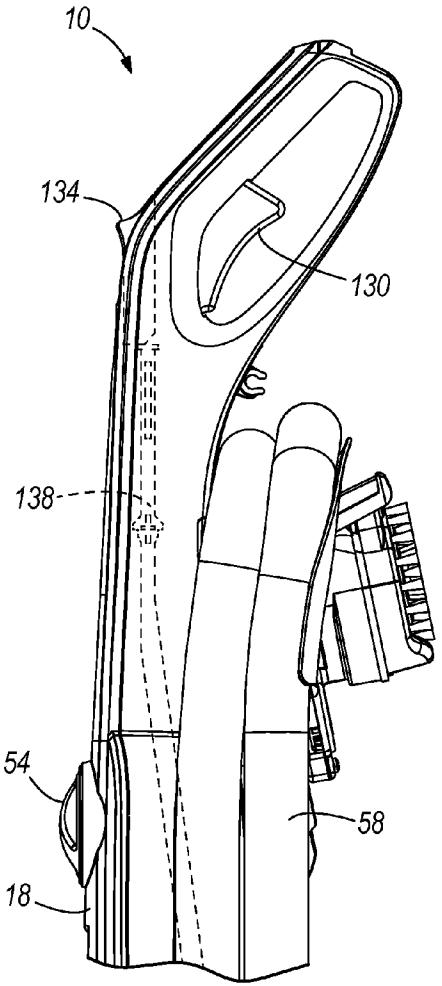
FIG. 4 is a side view of a portion of a handle of the extractor cleaning machine.

As shown in FIGS. 1 and 4, the extractor 10 includes a first actuator 130 and a second actuator 134. The illustrated actuators 130, 134 are supported by the handle 18, but may alternatively be positioned elsewhere on the extractor 10. In the illustrated embodiment, the first actuator 130 is a trigger and the second actuator 134 is a surge button. The trigger 130 and the surge button 134 are manually operable to adjust or change the voltage supplied to the motor 65 of the distributor 30, which in turn adjusts or changes the flow rate of cleaning fluid from the distribution nozzle 42.

Actuating (e.g., depressing) the trigger 130 increases the voltage supplied to the motor 65 of the distributor 30 such that the motor 65 and pump 64 operate at a higher speed, thereby increasing the output pressure of the pump 64. Actuating the trigger 130 also opens the valve 118 (FIG. 2) such that cleaning fluid flows through the floor conduit 110 to the distribution nozzle 42. Actuating (e.g., depressing) the surge button 134 further increases the voltage supplied to the motor 65 of the distributor 30 such that the motor 65 and pump 64 operate at an even higher speed, thereby further increasing the output pressure of the pump 64 such that the cleaning fluid can be discharged at an even higher flow rate. In the illustrated embodiment, the surge button 134 is coupled to the trigger 130 such that the trigger 130 is actuated before the surge button 134 may be actuated. In other embodiments, actuating the surge button 134 may automatically actuate the trigger 130 or the surge button 134 and the trigger 130 may be independently actuatable.

Figure 5:
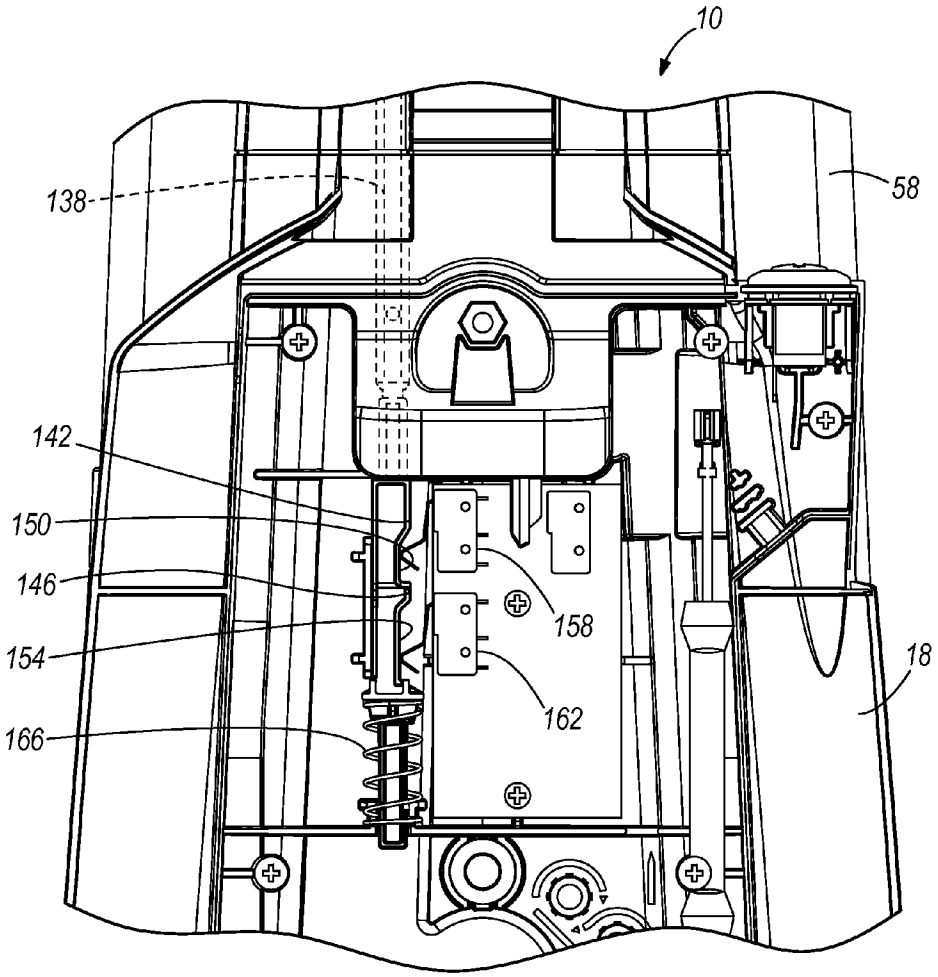
FIG. 5 is a front view of another portion of the handle of the extractor cleaning machine.

As shown in FIGS. 4 and 5, the trigger 130 and the surge button 134 are coupled to an elongated rod 138. The rod 138 extends through the handle 18 and is actuated (e.g., moved) relative to the handle 18 in response to actuation of the trigger 130 or the surge button 134. In the illustrated embodiment, the rod 138 is directly coupled to the trigger 130 and to the surge button 134 such that actuation of either the trigger 130 or the surge button 134 moves the rod 138 toward the foot 14 (downward in FIGS. 4 and 5). As shown in FIG. 5, the rod 138 includes two projected portions 142, 146 defining two recesses 150, 154. The recesses 150, 154 are shaped and sized to provide clearance for two microswitches 158, 162. The projected portions 142, 146 are configured to engage the microswitches 158, 162 when the rod 138 is moved relative to the handle 18. The microswitches 158, 162 are electrically coupled to the distributor 30 to adjust (e.g., increase) the voltage supplied to the motor 65 of the distributor 30 when actuated (e.g., closed).

Actuating the trigger 130 slides the rod 138 relative to the microswitches 158, 162 such that the first projected portion 142 engages and closes the first microswitch 158. When the first microswitch 158 is closed, the voltage supplied to the motor 65 of the distributor 30 is increased. Actuating the surge button 134 further slides the rod 138 relative to the microswitches 158, 162 such that the second projected portion 146 engages and closes the second microswitch 162. When the second microswitch 162 is closed, the voltage supplied to the motor 65 of the distributor 30 is further increased. A biasing member 166 (e.g., a coil spring) is coupled to the rod 138 to bias the projected portions 142, 146 out of engagement with the microswitches 158, 162 (upward in FIG. 5) when the trigger 130 and the surge button 134 are not actuated.

Figure 6:
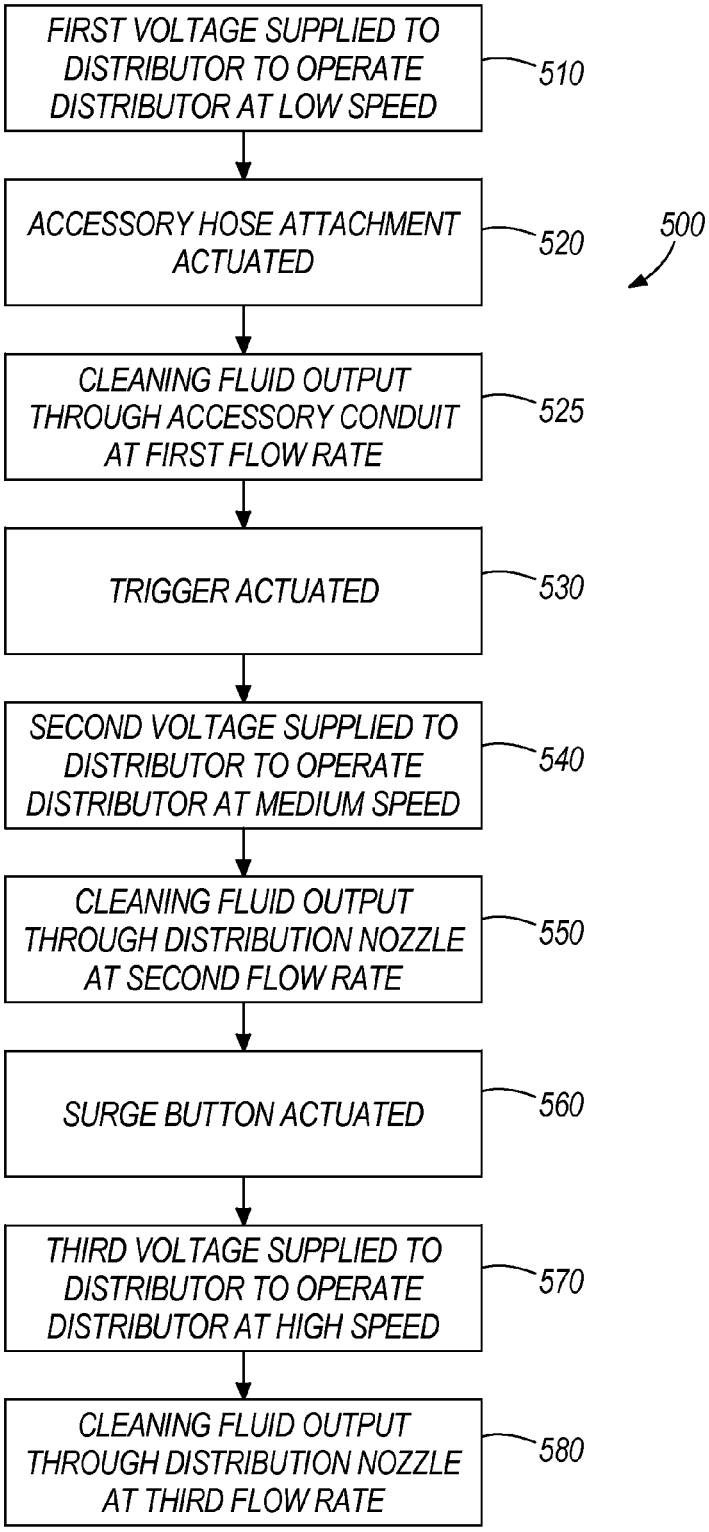
FIG. 6 is a flowchart depicting operation of the extractor cleaning machine.

FIG. 6 is a flowchart 500 depicting operation of the extractor 10 and, more particularly, the distributor 30, the trigger 130, and the surge button 134. As identified at step 510, the first voltage is supplied to the motor 65 of the distributor 30 when the extractor 10 is plugged in and turned on. The first voltage powers the motor 65 to operate or drive the pump 64 of the distributor 30 at a relatively low speed and a correspondingly low output pressure. In this condition, the valve 118 (FIG. 3) is closed because the trigger 130 has not been actuated.

To apply cleaning fluid (e.g., water or a mixture of water and detergent) to a surface using the accessory hose 58, a user actuates the accessory hose attachment at step 520. Upon actuation of the accessory hose attachment cleaning fluid flows through the accessory conduit at a first accessory-cleaning flow rate at step 525. The accessory-cleaning flow rate is thus associated with the relatively low operating speed of the pump. It should be appreciated that changes in fluid pressure associated with the opening and closing of the stop valve will likely result in modest fluctuations in the operating speed of the pump. Such fluctuations should nonetheless be construed as the pump continuing to operate at the relatively low operating speed.

In the illustrated embodiment, the accessory hose attachment includes a simple mechanical stop-valve and is not electrically coupled to the distributor 30 such that actuation of the stop-valve does not include a corresponding increase in the speed of the pump 64. In other embodiments, the stop-valve of the accessory hose 58 can include an electrical switch (e.g. a microswitch) that communicates with control circuitry that increases or otherwise alters the speed of the pump 64. In still other embodiments, an additional solenoid can be provided that selectively restricts flow through the accessory conduit 106. Such additional solenoid could be activated by, for example, a switch on the accessory hose 58 that functions to open the additional solenoid to allow fluid to flow through the accessory conduit. The additional solenoid and control switch can be used in conjunction with or as an alternative to the previously described manually activated stop-valve. Moreover, the additional solenoid and control switch may operate with or without a corresponding increase or other change in the speed of the pump 64.

At step 530, the trigger 130 is actuated by the user, typically by squeezing the trigger 130 with the user's index finger. Actuating the trigger 130 moves the rod 138 relative to the handle 18 to close the first microswitch 158 (FIG. 5). When the first microswitch 158 is closed, a second voltage is supplied to the motor 65 of the distributor 30, as identified at step 540. The second voltage is greater than the first voltage such that the motor 65 operates or drives the pump 64 of the distributor 30 at a second, relatively medium speed that is greater than the first, relatively low speed. Actuating the trigger 130 also opens the valve 118 (FIG. 3) such that cleaning fluid flows through the floor conduit 110 and is output through the distribution nozzle 42. When the trigger 130 is actuated, the valve 118 is opened, and the voltage to the motor 65 is increased, cleaning fluid is output through the distribution nozzle 42 at a second flow rate, as identified at step 550. The second flow rate could also be considered to be a first floor-cleaning flow rate because it is the first flow rate at which fluid is being distributed to the floor by the distribution nozzle 42. The first floor-cleaning flow rate is greater than the accessory-cleaning flow rate such that a greater volume of cleaning fluid per unit of time is output by the distributor 30 through the distribution nozzle 42 than would be output through the accessory hose 58 if the hand-tool was being actuated instead of the trigger 130.

At step 560, the surge button 134 is actuated by the user, typically by pressing the button 134 with the user's thumb. Actuating the surge button 134 moves the rod 138 relative to the handle 18 to close the second microswitch 162 (FIG. 5) such that both microswitches 158, 162 are closed. When the second microswitch 162 is closed, a third voltage is supplied to the pump 65 of the distributor 30, as identified at step 570. The third voltage is greater than the second voltage such that the motor 65 operates or drives the pump 64 of the distributor 30 at a third, relatively high speed that is greater than the second, relatively medium speed. In this condition, cleaning fluid is output through the distribution nozzle 42 at a second floor-cleaning flow rate by the pump 64 of the distributor 30, as identified at step 580. The second floor-cleaning flow rate is greater than the first floor-cleaning flow rate such that an even greater volume of cleaning fluid per unit of time is output by the distributor 30 through the distribution nozzle 42. The surge button 134 may therefore be depressed by the user in selective bursts to output extra cleaning fluid to clean particularly dirty or soiled areas.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. An extractor cleaning machine comprising:

a base movable along a surface to be cleaned, the base including a distribution nozzle and a suction nozzle;

a suction source supported by the base and in fluid communication with the suction nozzle;

a pump in fluid communication with the distribution nozzle, the pump operable to deliver cleaning fluid to the distribution nozzle and having a first operating speed and a second operating speed, both the first and second operating speeds being non-zero operating speeds, and the second operating speed being higher than the first operating speed;

a manually operable actuator movable between a first position and a second position;

a normally-closed valve between the pump and the distribution nozzle; and an actuating member operably coupling the actuator to the pump and to the valve, wherein movement of the actuator from the first position to the second position moves the actuating member to change the pump from the first operating speed to the second operating speed and to open the valve to allow cleaning fluid to flow from the pump to the distribution nozzle.

2. The extractor cleaning machine of claim 1, wherein the actuator is a first actuator, the extractor cleaning machine further comprising a second manually operable actuator movable between a first position and a second position, wherein the pump has a third operating speed that is higher than the second operating speed, and wherein movement of the second actuator from the first position to the second position increases the pump speed to the third operating speed.

3. The extractor cleaning machine of claim 2, further comprising a handle pivotally coupled to the base, wherein the first actuator and the second actuator are positioned on and pivotable with the handle.

4. The extractor cleaning machine of claim 3, wherein movement of the first actuator from the first position to the second position advances the actuating member in a first direction relative to the handle, and movement of the second actuator from the first position to the second position further advances the actuating member in the first direction relative to the handle.

5. The extractor cleaning machine of claim 4, further comprising a first switch in electrical communication with the pump, wherein the actuating member is engageable with the first switch to change the state of the first switch to increase a voltage supplied to the pump in response to movement of the first actuator from the first position to the second position, and wherein the pump increases in operating speed from the first operating speed to the second operating speed in response to the increase in voltage.

6. The extractor cleaning machine of claim 5, further comprising a second switch in electrical communication with the pump, wherein the actuating member is engageable with the second switch to change the state of the second switch to increase a voltage supplied to the pump in response to movement of the second actuator from the first position to the second position, and wherein the pump increases in operating speed from the second operating speed to the third operating speed in response to the increase in voltage.

7. The extractor cleaning machine of claim 1, wherein manually operating the actuator substantially simultaneously opens the valve and changes the pump from the first operating speed to the second operating speed.

8. The extractor cleaning machine of claim 1, wherein flow of cleaning fluid to the distribution nozzle is precluded when the pump operates at the first operating speed.

9. The extractor cleaning machine of claim 1, further comprising an accessory hose in communication with the suction source and the pump, the accessory hose including a manually-operable hand tool, and wherein operation of the hand tool delivers cleaning fluid to the surface while the pump operates at the first operating speed.

10. The extractor cleaning machine of claim 1, further comprising a switch associated with the actuator and in electrical communication with the pump, wherein the switch changes state in response to movement of the actuator from the first position to the second position to increase a voltage supplied to the pump, and wherein the pump increases in operating speed from the first operating speed to the second operating speed in response to the increase in voltage.

11. The extractor cleaning machine of claim 1, further comprising a handle pivotally coupled to the base, wherein the actuator is positioned on and pivotable with the handle, and movement of the actuator from the first position to the second position advances the actuating member in a first direction relative to the handle.

12. The extractor cleaning machine of claim 11, further comprising a switch in electrical communication with the pump, wherein the actuating member is engageable with the switch to change the state of the switch in response to movement of the actuator from the first position to the second position to increase a voltage supplied to the pump, and wherein the pump increases in operating speed from the first operating speed to the second operating speed in response to the increase in voltage.

13. An extractor cleaning machine comprising:

a base movable along a surface to be cleaned, the base including a distribution nozzle and a suction nozzle;

a handle pivotally coupled to the base for moving the base along the surface to be cleaned;

a suction source supported by the base and in fluid communication with the suction nozzle;

an accessory hose in fluid communication with the suction source;

a distributor supported by the base and in fluid communication with the distribution nozzle and the accessory hose, the distributor operable to deliver cleaning fluid to the distribution nozzle and to the accessory hose and having a first operating speed associated with delivery of cleaning fluid to the accessory hose at a first flow rate, a second operating speed associated with delivery of cleaning fluid to the distribution nozzle at a second flow rate, and a third operating speed associated with delivery of cleaning fluid to the distribution nozzle at a third flow rate that is greater than the second flow rate, wherein the first, second, and third operating speeds are non-zero operating speeds, wherein the second operating speed is higher than the first operating speed, and wherein the third operating speed is higher than the second operating speed;

a manually operable actuator, wherein actuation of the manually operable actuator causes the distributor to change from operation at the first operating speed to operation at the second operating speed; and a valve between the distributor and the distribution nozzle, the valve being closed during operation of the distributor at the first operating speed, and wherein actuation of the manually operable actuator opens the valve to permit flow of cleaning fluid from the distributor to the distribution nozzle.

14. The extractor cleaning machine of claim 13, wherein the manually operable actuator is a first manually operable actuator, the extractor cleaning machine further comprising a second manually operable actuator, wherein actuation of the second manually operable actuator causes the distributor to change from operation at the second operating speed to operation at the third operating speed.

15. The extractor cleaning machine of claim 14, wherein the first manually operable actuator and the second manually operable actuator are both located on the handle.

16. The extractor cleaning machine of claim 14, further comprising a first microswitch and a second microswitch, wherein actuation of the first manually operable actuator closes the first microswitch to increase a voltage supplied to the distributor, and wherein actuation of the second manually operable actuator closes the second microswitch to further increase the voltage supplied to the distributor.

17. An extractor cleaning machine comprising:

a base movable along a surface to be cleaned, the base including a distribution nozzle and a suction nozzle;

a handle coupled to the base to facilitate movement of the base along the surface;

a suction source in fluid communication with the suction nozzle, the suction source operable to draw fluid and dirt from the surface through the suction nozzle;

a recovery tank in fluid communication with the suction source to receive and store fluid and dirt drawn through the suction nozzle;

a distributor in fluid communication with the distribution nozzle, the distributor operable to distribute a cleaning fluid to the surface;

a supply tank configured to receive and store the cleaning fluid, the supply tank in fluid communication with the distributor for supplying the cleaning fluid to the distributor;

a normally closed valve between the distributor and the distribution nozzle; and an actuator manually operable, electrically coupled to the distributor, and coupled to the valve;

wherein a first voltage is supplied to the distributor such that the distributor outputs the cleaning fluid at a first flow rate, the first voltage and the first flow rate being greater than zero, and, when the actuator is actuated, a second voltage is supplied to the distributor such that the distributor outputs the cleaning fluid at a second flow rate, the second voltage being greater than the first voltage and the second flow rate being greater than the first flow rate, and wherein the valve opens in response to operation of the actuator.

18. The extractor cleaning machine of claim 17, wherein the actuator is a first actuator, and further comprising a second actuator manually operable and electrically coupled to the distributor, wherein, when the second actuator is actuated, a third voltage is supplied to the distributor such that the distributor outputs the cleaning fluid at a third flow rate, the third voltage being greater than the second voltage and the third flow rate being greater than the second flow rate.

19. The extractor cleaning machine of claim 17, further comprising an accessory conduit in fluid communication with the distributor, wherein the distributor distributes the cleaning fluid at the first flow rate through the accessory conduit and distributes the cleaning fluid at the second flow rate through the distribution nozzle.

20. The extractor cleaning machine of claim 17, wherein the valve is closed when the first voltage is supplied to the distributor and opened when the second voltage is supplied to the distributor.

21. An extractor cleaning machine comprising:

a base including a floor-cleaning distribution nozzle;

a hose coupled to the base, the hose including a surface-cleaning nozzle;

a distributor, the distributor having an off configuration, a first operating speed, a second operating speed greater than the first operating speed, and a third operating speed greater than the second operating speed, the distributor in selective fluid communication with the floor-cleaning distribution nozzle and the surface-cleaning nozzle, wherein the distributor operates at the first operating speed for supplying cleaning fluid to the surface-cleaning nozzle, and operates at one of the second operating speed and the third operating speed for supplying cleaning fluid to the floor-cleaning distribution nozzle;

an actuator; and a valve positioned to interrupt fluid communication between the distributor and the floor-cleaning distribution nozzle, wherein the valve is closed when the distributor operates at the first operating speed and wherein actuating the actuator opens the valve and increases the distributor speed from the first operating speed to the second operating speed.

22. The extractor cleaning machine of claim 21, wherein when the extractor cleaning machine is turned on, the distributor changes from the off configuration to the first operating speed.

23. The extractor cleaning machine of claim 22, wherein the hose includes a normally-closed stop-valve, and wherein when the extractor cleaning machine is turned on and the stop-valve is opened, the surface-cleaning nozzle discharges cleaning fluid at an accessory-cleaning flow rate associated with the first operating speed.

24. The extractor cleaning machine of claim 21, wherein the actuator is a first actuator, the extractor cleaning machine further comprising a second actuator, wherein actuating the second actuator increases the distributor speed from the second operating speed to the third operating speed.

* * * * *